US010038283B2

(12) United States Patent
Oddsen

(10) Patent No.: US 10,038,283 B2
(45) Date of Patent: Jul. 31, 2018

(54) ELECTRICAL RECEPTACLE

(71) Applicant: Hubbell Incorporated, Shelton, CT (US)

(72) Inventor: Dennis Alan Oddsen, Northport, NY (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 15/601,134

(22) Filed: May 22, 2017

(65) Prior Publication Data

US 2017/0346235 A1 Nov. 30, 2017

Related U.S. Application Data

(60) Provisional application No. 62/340,575, filed on May 24, 2016.

(51) Int. Cl.

| | |
|---|---|
| ***H01R 13/652*** | (2006.01) |
| ***H01R 13/703*** | (2006.01) |
| ***H01R 24/78*** | (2011.01) |
| ***H01R 25/00*** | (2006.01) |
| ***H01R 27/02*** | (2006.01) |
| ***H01R 31/06*** | (2006.01) |

(52) U.S. Cl.

CPC ..... *H01R 13/652* (2013.01); *H01R 13/7035* (2013.01); *H01R 13/7036* (2013.01); *H01R 24/78* (2013.01); *H01R 25/006* (2013.01); *H01R 27/02* (2013.01); *H01R 31/06* (2013.01)

(58) Field of Classification Search

CPC .. H01R 13/7036; H01R 13/703; H01R 13/70; H01R 2103/00

USPC ..... 200/51 R, 51.02, 51.03, 51.05, 51.09, 200/51.11; 439/188

See application file for complete search history.

(56) References Cited

U.S. PATENT DOCUMENTS 3,618,065 A * 11/1971 Trip ..... G08B 13/1409 200/51.09
3,649,839 A 3/1972 Appleton
4,008,403 A * 2/1977 Rose ..... H01R 33/962 200/51.09

(Continued)

OTHER PUBLICATIONS

PCT/US2017/033763 International Search Report and Written Opinion dated Aug. 1, 2017 (14 pages).

*Primary Examiner* — Gary Paumen
(74) *Attorney, Agent, or Firm* — Michael Best & Friedrich, LLP

(57) ABSTRACT

An electrical receptacle is selectively coupled to a power plug, and the power plug includes a plurality of prongs insertable into the electrical receptacle. The electrical receptacle includes a contact configured to be engageable with one of the plurality of prongs, a power relay in electrical communication with the power source and the contact, and a switch electrically coupled to the power relay. The switch is moveable between a first position and a second position. The switch is biased toward the first position. The power relay is configured to disable electrical communication between the power source and the contact when the switch is positioned in the first position. The power relay is also configured to enable electrical communication between the power source and the contact in response to the one of the plurality of prongs slidably engaging the switch to move the switch into the second position.

18 Claims, 10 Drawing Sheets

(56) References Cited

U.S. PATENT DOCUMENTS

| | | | | |
|---|---|---|---|---|
| 4,442,327 | A * | 4/1984 | West | H01H 9/08 200/243 |
| 4,853,823 | A | 8/1989 | Arechavaleta et al. | |
| 5,095,182 | A | 3/1992 | Thompson | |
| 5,113,045 | A | 5/1992 | Crofton | |
| 5,256,076 | A | 10/1993 | Hamlin | |
| 5,281,859 | A | 1/1994 | Crane | |
| 5,320,545 | A | 6/1994 | Brothers | |
| 5,374,199 | A | 12/1994 | Chung | |
| 5,621,256 | A | 4/1997 | Crane et al. | |
| 6,111,210 | A | 8/2000 | Allison | |
| 6,183,264 | B1 | 2/2001 | Harsanyi | |
| 6,229,107 | B1 | 5/2001 | Flint et al. | |
| 6,428,334 | B1 | 8/2002 | Skarie et al. | |
| 6,660,950 | B2 * | 12/2003 | Fonseca | G06F 21/85 200/51 R |
| 6,678,131 | B2 * | 1/2004 | Chapman | H01R 13/7036 200/51.09 |
| 6,753,624 | B2 | 6/2004 | Miwa | |
| 6,984,141 | B1 | 1/2006 | Beski, Sr. et al. | |
| 7,462,957 | B2 | 12/2008 | Camwell et al. | |
| 7,575,467 | B2 | 8/2009 | Ferguson et al. | |
| 7,952,840 | B2 | 5/2011 | Ford et al. | |
| 2003/0124893 | A1 | 7/2003 | Campbell | |
| 2007/0149013 | A1 | 6/2007 | Eastham et al. | |
| 2008/0160810 | A1 * | 7/2008 | Ferguson | H01R 13/44 439/188 |
| 2008/0248667 | A1 * | 10/2008 | Sun | H01R 13/7038 439/188 |
| 2011/0117760 | A1 | 5/2011 | Winstanley et al. | |
| 2011/0177706 | A1 | 7/2011 | Boncelet | |
| 2011/0230073 | A1 | 9/2011 | Ford et al. | |
| 2016/0079718 | A1 * | 3/2016 | Rohr | H01R 13/7038 439/188 |

* cited by examiner

ELECTRICAL RECEPTACLE

CROSS-REFERENCE TO RELATED APPLICATIONS

This application claims priority to U.S. Provisional Patent Application No. 62/340,575, filed May 24, 2016, the entire content is incorporated herein by reference.

BACKGROUND

The present disclosure relates to the field of electrical receptacles, and particularly to electrical receptacles that automatically energize when an electrical plug is inserted in a position within the electrical receptacle.

SUMMARY

In one aspect, an electrical receptacle is electrically coupled to a power source. The electrical receptacle is selectively coupled to a power plug, and the power plug includes a plurality of prongs insertable into the electrical receptacle. The electrical receptacle includes a first contact configured to be engageable with a first prong of the plurality of prongs, a second contact configured to be engageable with a second prong of the plurality of prongs, a power relay in electrical communication with the power source and the first contact, and a switch electrically coupled to the power relay and positioned adjacent an end of the second contact. The switch is moveable between a first position and a second position. The switch is biased toward the first position. The power relay is configured to disable electrical communication between the power source and the first contact when the switch is positioned in the first position. The power relay is also configured to enable electrical communication between the power source and the first contact in response to the second prong slidably engaging the switch to move the switch into the second position.

In another aspect, an electrical receptacle is electrically coupled to a power source. The electrical receptacle is selectively coupled to a power plug, and the power plug includes a plurality of prongs insertable into the electrical receptacle. The electrical receptacle includes a contact configured to be engageable with one of the plurality of prongs, a power relay in electrical communication with the power source and the contact, and a switch electrically coupled to the power relay. The switch is moveable between a first position and a second position. The switch is biased toward the first position. The power relay is configured to disable electrical communication between the power source and the contact when the switch is positioned in the first position. The power relay is also configured to enable electrical communication between the power source and the contact in response to the one of the plurality of prongs slidably engaging the switch to move the switch into the second position.

In yet another aspect, an electrical receptacle is electrically coupled to a power source. The electrical receptacle is selectively coupled to a power plug, and the power plug includes a plurality of prongs insertable into the electrical receptacle. The electrical receptacle includes a contact configured to be engageable with the one of the plurality of prongs, a power relay in electrical communication with the power source and the contact, and a switch electrically coupled to the power relay. The switch is moveably biased in a direction substantially perpendicular to an insertion direction of the one of the plurality of prongs within the electrical receptacle. The power relay is configured to block electrical communication between the power source and the contact when the switch is positioned in the first position. The power relay is also configured to enable electrical communication between the power source and the contact in response to the one of the plurality of prongs moving the switch into the second position.

Other aspects will become apparent by consideration of the detailed description and accompanying drawings.

DETAILED DESCRIPTION

Figure 1:
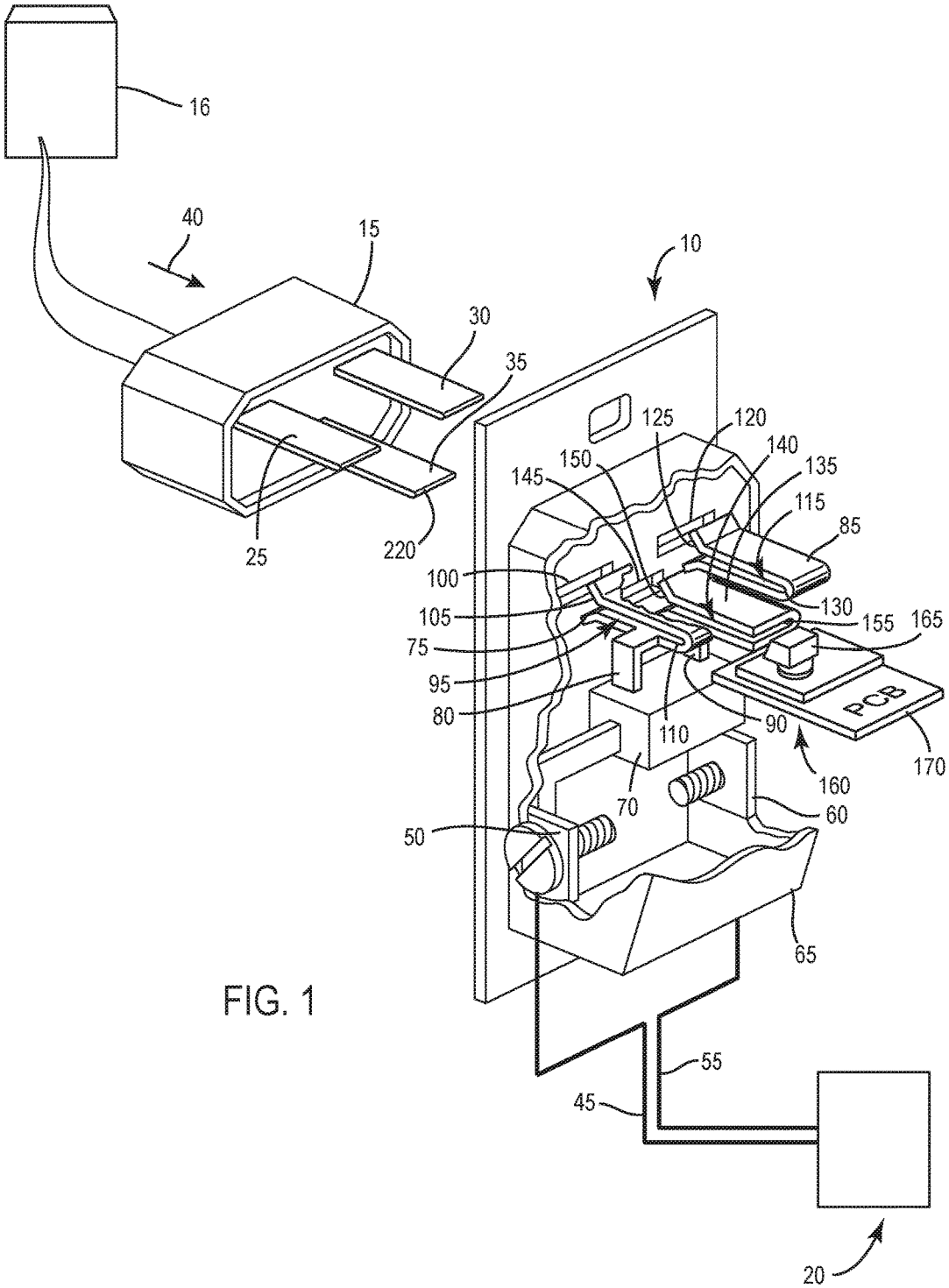
FIG. 1 is a perspective view of an electrical plug and an electrical receptacle.

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

FIGS. 1-10 illustrate an electrical receptacle 10 that is selectively coupled to an electrical plug 15. In one embodiment, the electrical plug 15 may be coupled to electrical device(s) 16 (e.g., data centers, a plurality of computer processors, etc.) including electrical circuits requiring about 5 amperes (i.e., amps) to about 10 amps and about 400 volts.

In other embodiments, different electrical circuits including different current and/or voltage requirements may be coupled to the electrical plug 15. In the illustrated embodiment, the electrical receptacle 10 is coupled to a direct current (i.e., DC) power source 20 that is configured to power the electrical devices 16, but in other embodiments, the electrical receptacle 10 may be coupled to an alternating current (i.e., AC) power source. The electrical plug 15 includes a positive voltage prong or first power prong 25, a negative voltage prong or second power prong 30, and a third prong or grounding prong 35 that are insertable within the electrical receptacle 10 along an insertion direction 40 (FIG. 4) to electrically couple the electrical devices 16 to the power source 20. In the illustrated embodiment, the first prong 25 is oriented generally in the same plane as the second prong 30, and the grounding prong 35 is non-planar with respect to the prongs 25, 30 and positioned between the prongs 25, 30. Stated another way, the grounding prong 35 is laterally offset from the plane of the prongs 25, 30.

As shown in FIG. 1, the illustrated power source 20 is in electrical communication with the electrical receptacle 10 by a first electrical wire 45 coupled to a positive voltage terminal or first terminal 50 and by a second electrical wire 55 coupled to a negative voltage terminal or a second terminal 60. The terminals 50, 60 are affixed to a housing 65, which is partially illustrated in FIGS. 1, 2, 4, 5, 7, and 10, of the electrical receptacle 10. The terminals 50, 60 also extend towards and are electrically coupled to a power relay 70. The illustrated power relay 70 is configured to selectively allow or block electrical current from the power source 20 to pass through the power relay 70. The power relay 70 is coupled to a positive voltage contact or first contact 75 via a first connector 80 and a negative voltage contact or second contact 85 via a second connector 90.

Figure 2:
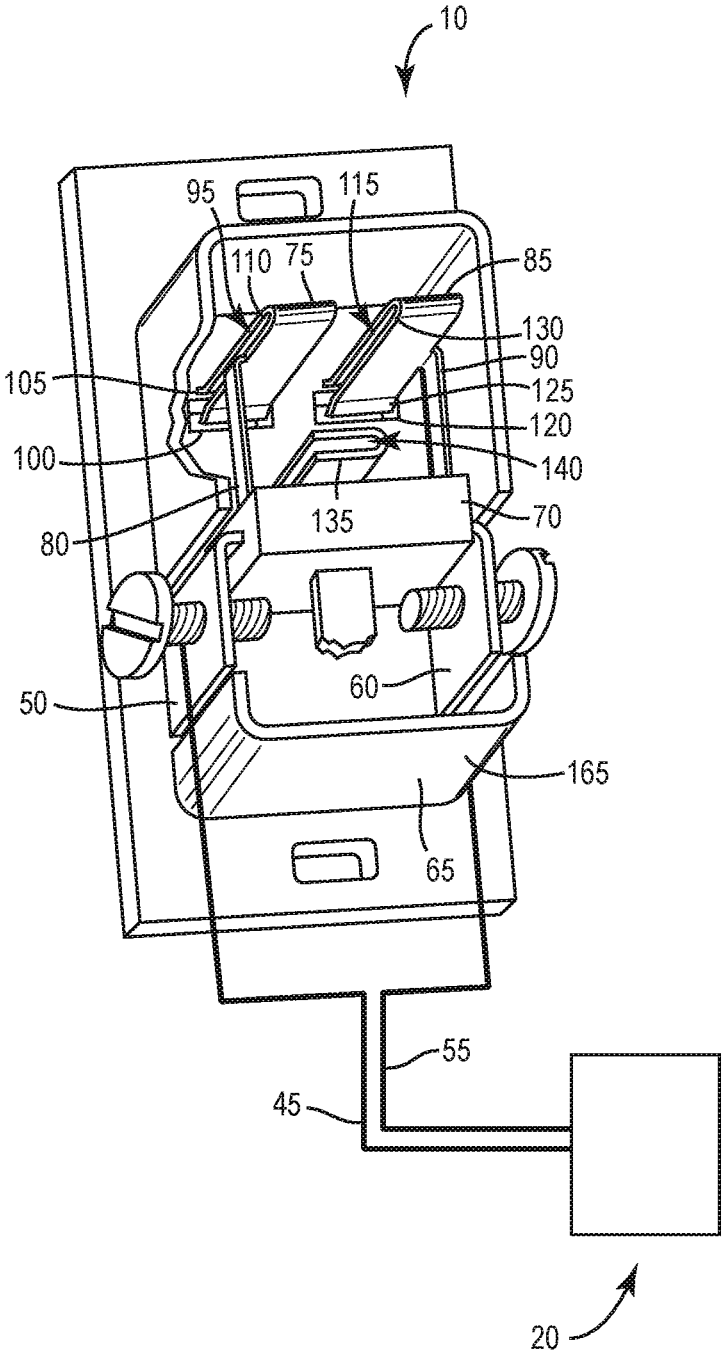
FIG. 2 is a perspective view of a portion of the electrical receptacle of FIG. 1.
Figure 10:
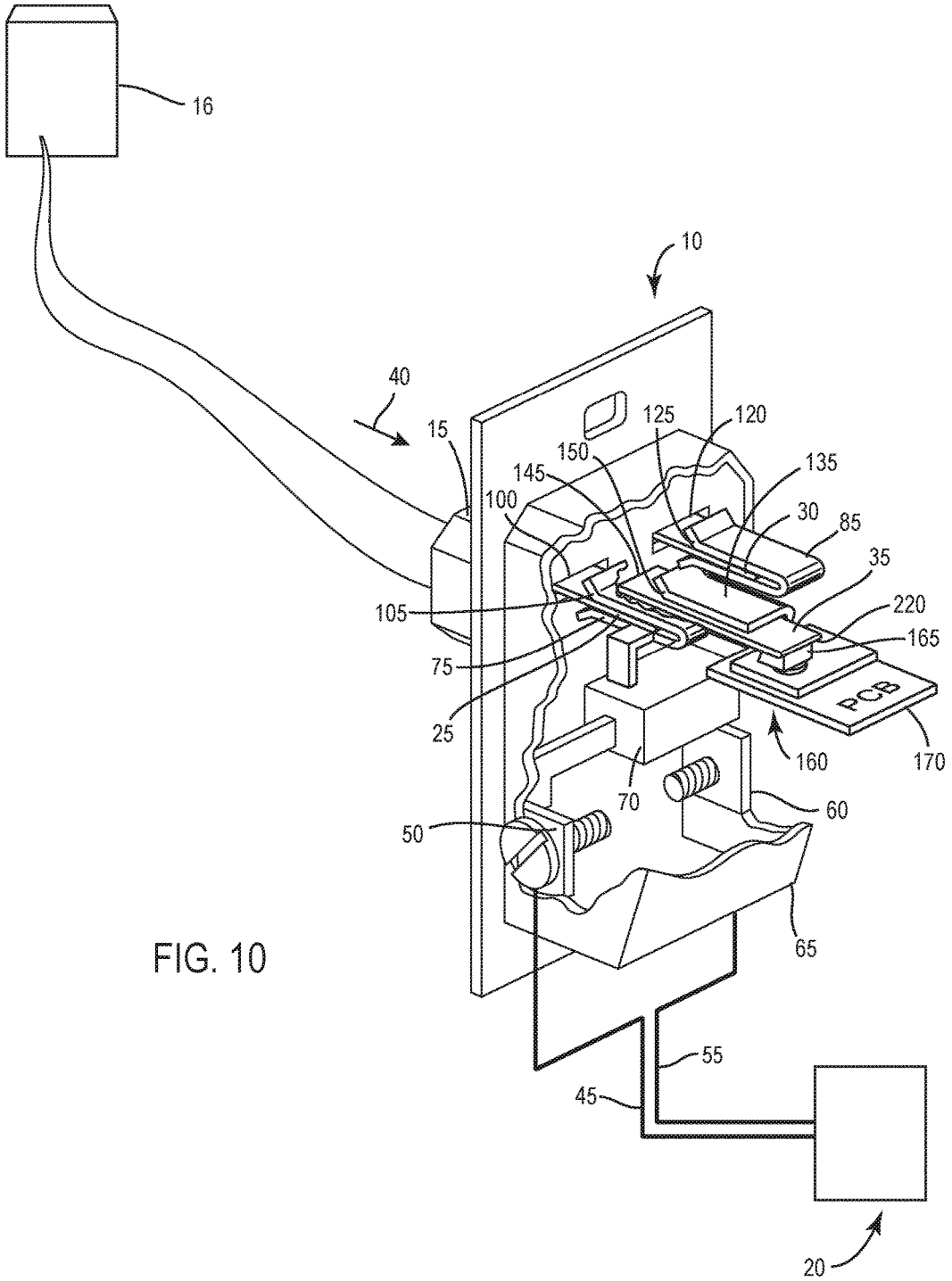
FIG. 10 is a perspective view of the electrical receptacle of FIG. 7.

As shown in FIGS. 1 and 2, the first contact 75 defines a first channel 95 (in some embodiments, the first channel has a U-shaped profile) that aligns with a first opening 100 of the housing 65. In particular, a first bent end 105 of the first channel 95 opens towards the first opening 100, and a second end 110 of the first channel 95 is closed. The illustrated first channel 95 is configured to receive the first prong 25 such that the first prong 25 is in direct contact with the first contact 75 (FIGS. 5-8 and 10 show separation between the first prong 25 and the first contact 75 only to clearly illustrate each component) when the electrical plug 15 is inserted into the electrical receptacle 10. Likewise, the second contact 85 defines a second channel 115 (similar to the construction of the first channel 95) that aligns with a second opening 120 of the housing 65. In particular, a first bent end 125 of the second channel 115 opens towards the second opening 120, and a second end 130 of the second channel 115 is closed. The illustrated second channel 115 is configured to receive the second prong 30 such that the second prong 30 is in direct contact with the second contact 85 (FIG. 10 shows separation between the second prong 30 and the second contact 85 only to clearly illustrate each component) when the electrical plug 15 is inserted into the electrical receptacle 10.

Figure 3:
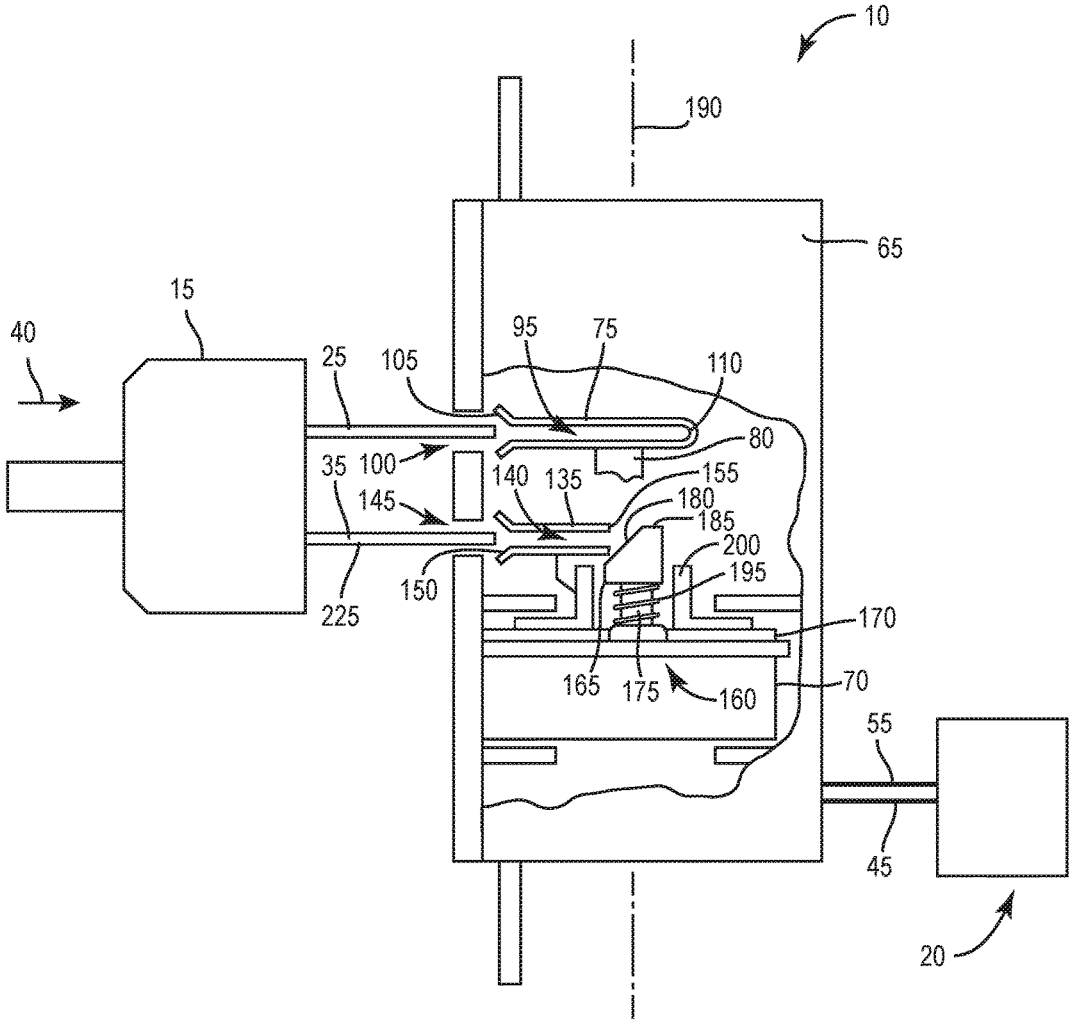
FIG. 3 is a partial cross sectional view of the electrical receptacle of FIG. 1 illustrating the electrical plug in a first position.

With continued reference to FIGS. 1 and 2, the electrical receptacle 10 also includes a grounding contact or third contact 135 that is affixed to the housing 65 and defines a third channel 140 (in the illustrated embodiment, the third channel has a lateral U-shaped profile, as best shown in FIG. 2) that aligns with a third opening 145 of the housing 65. In particular, a first bent end 150 of the grounding contact 135 opens towards the third opening 145, and a second end 155 of the grounding contact 135 is open (FIG. 3). The illustrated grounding contact 135 is configured to receive the grounding prong 35 such that the grounding prong 35 is in direct contact with the grounding contact 135 (FIGS. 5-8 and 10 show separation between the grounding prong 35 and the third contact 135 only to clearly illustrate each component) when the electrical plug 15 is inserted into the electrical receptacle 10.

Figure 7:
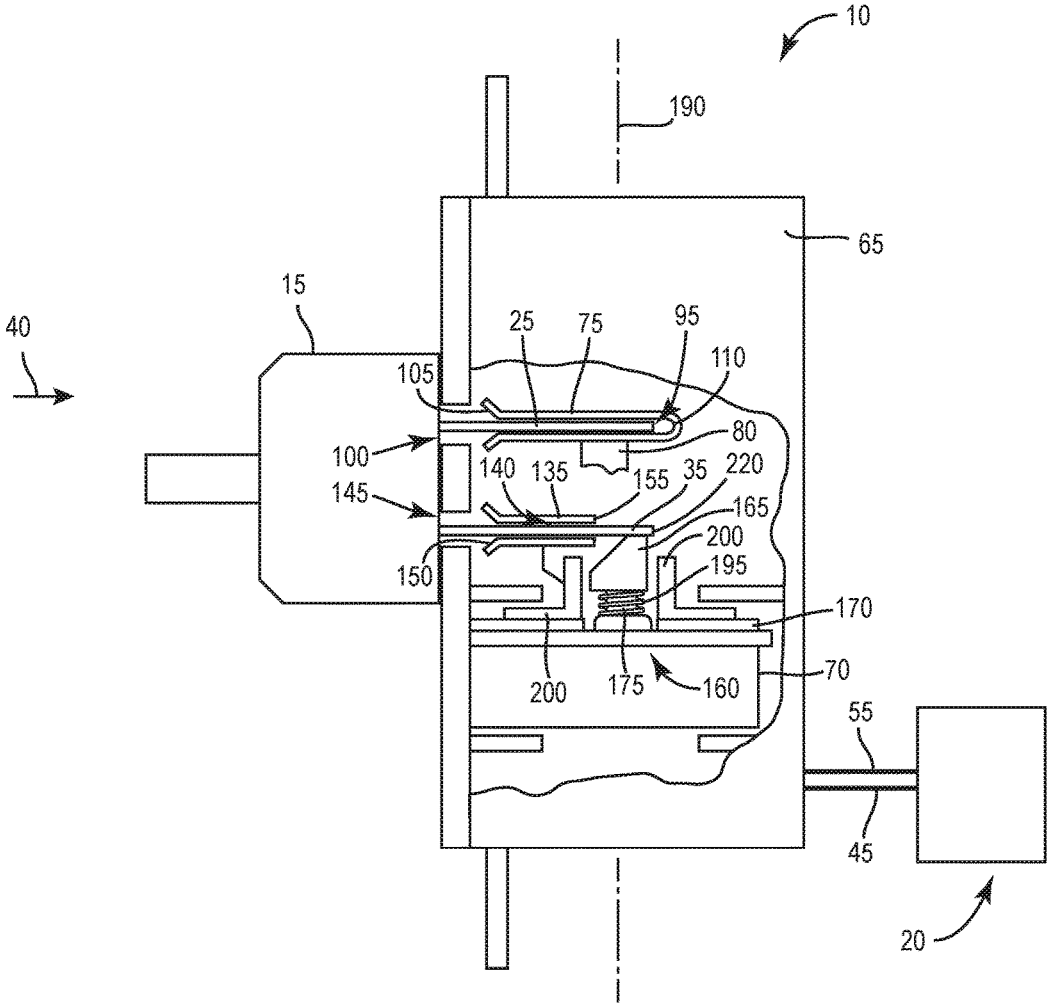
FIG. 7 is a partial cross sectional view of the electrical receptacle of FIG. 1 illustrating the electrical plug inserted within the electrical receptacle in a third position.
Figure 8:
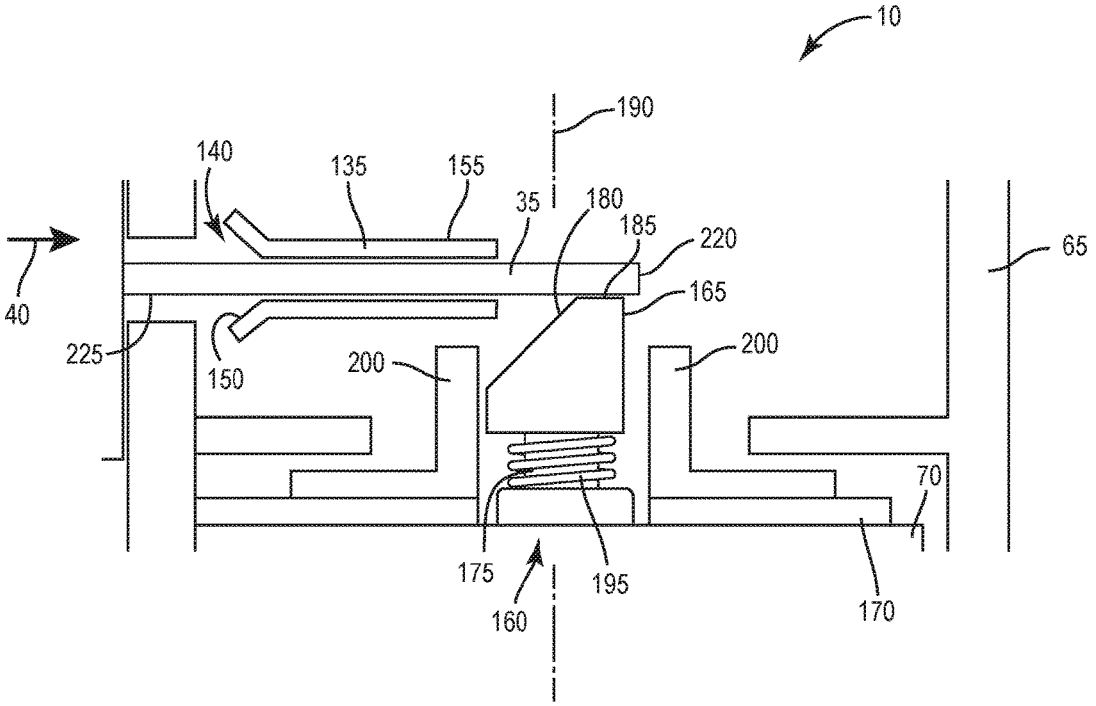
FIG. 8 is a detailed view of the third position of the electrical plug of FIG. 7 and the switch of the electrical receptacle.

As shown in FIGS. 1 and 3, a switch 160 (the switch 160 is omitted from FIG. 2 to clearly illustrate other components of the electrical receptacle 10) is positioned adjacent the second end 155 of the grounding contact 135 and includes a body 165 supported on a printed circuit board (i.e., PCB) 170 via a pin 175 with the PCB 170 coupled to the power relay 70. The illustrated body 165 includes and a ramped or inclined surface 180 facing the third channel 140 and a top surface 185. In the illustrated embodiment, the body 165 is biased upwardly towards the grounding contact 135 along an axis 190 that is generally perpendicular to the insertion direction 40 via a biasing member 195 (e.g., a coil spring). The illustrated body 165 is moveable between a first position with the ramped surface 180 aligning with the third channel 140 (FIGS. 4-6) and a second position with the top surface 185 positioned below the third channel 140 (FIGS. 7 and 8). The body 165 is also positioned between walls 200 that are fixed relative to the housing 65 to guide the body 165 between the first and second positions. In one embodiment, the walls 200 may be positioned adjacent two opposing sides of the body 165. In other embodiments, the walls 200 may form a single wall that surrounds all sides the body 165. In further embodiments, the switch 160 may be positioned between the contacts 75, 85 and the grounding contact 135 such that the body 165 is biased downwardly towards the grounding contact 135.

Figure 4:
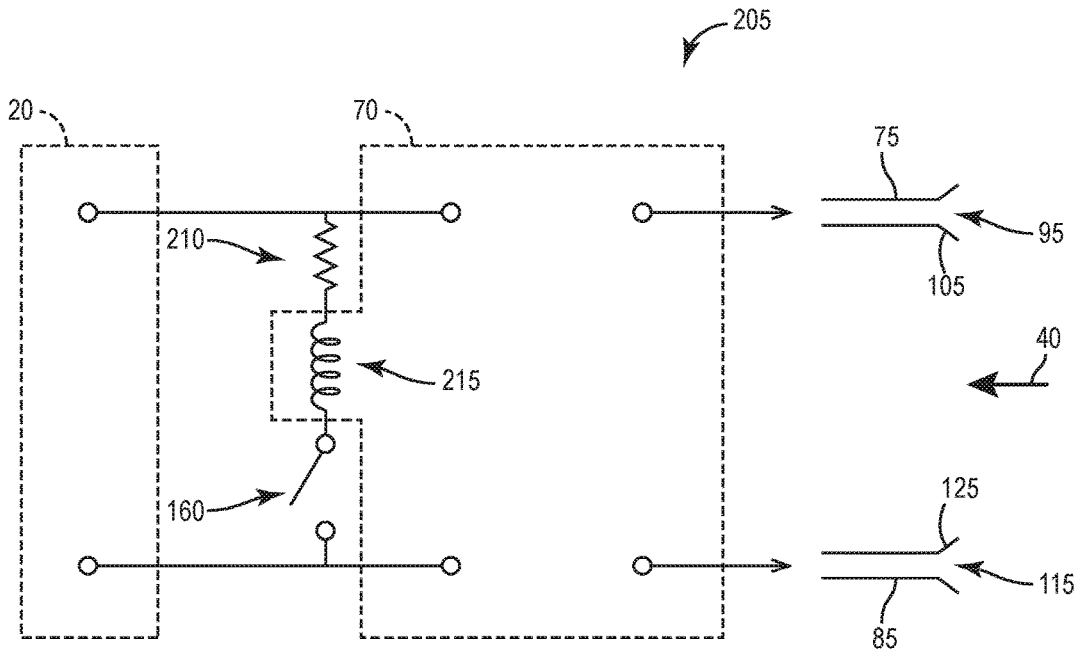
FIG. 4 illustrates an electrical circuit diagram of the electrical receptacle of FIG. 1 with a switch in a first position.

With reference to FIG. 4, a circuit 205 of the electrical receptacle 10 is illustrated with the switch 160 positioned in an electrically open state. In particular, the switch 160 and the power relay 70 are positioned electrically between the power source 20 and the prongs 25, 30, and the switch 160 is positioned electrically between the power source 20 and the power relay 70. The switch 160 is also constructed in parallel with the power source 20 and the power relay 70 via a resistor 210 and an inductor 215.

With reference to FIGS. 3 and 5-8, the electrical plug 15 is shown at various stages of insertion into the electrical receptacle 10 along the insertion direction 40. An initial or first stage of insertion as illustrated in FIG. 3 includes the prongs 25, 30, 35 (only the prongs 25, 35 are illustrated) received within the respective openings 100, 120, 145 such that each prong 25, 30, 35 aligns with the respective channels 95, 115, 140. The bent first ends 105, 125, 150 also aid in guiding the prongs 25, 30, 35 into the respective channels 95, 115, 140. In the first stage of insertion, the switch 160 is biased into the first position. When the switch 160 is positioned in the first position, the power relay 70 blocks the flow of electrical current from the power source 20 to the contacts 75, 85 (e.g., the contacts 75, 85 are de-energized).

Figure 5:
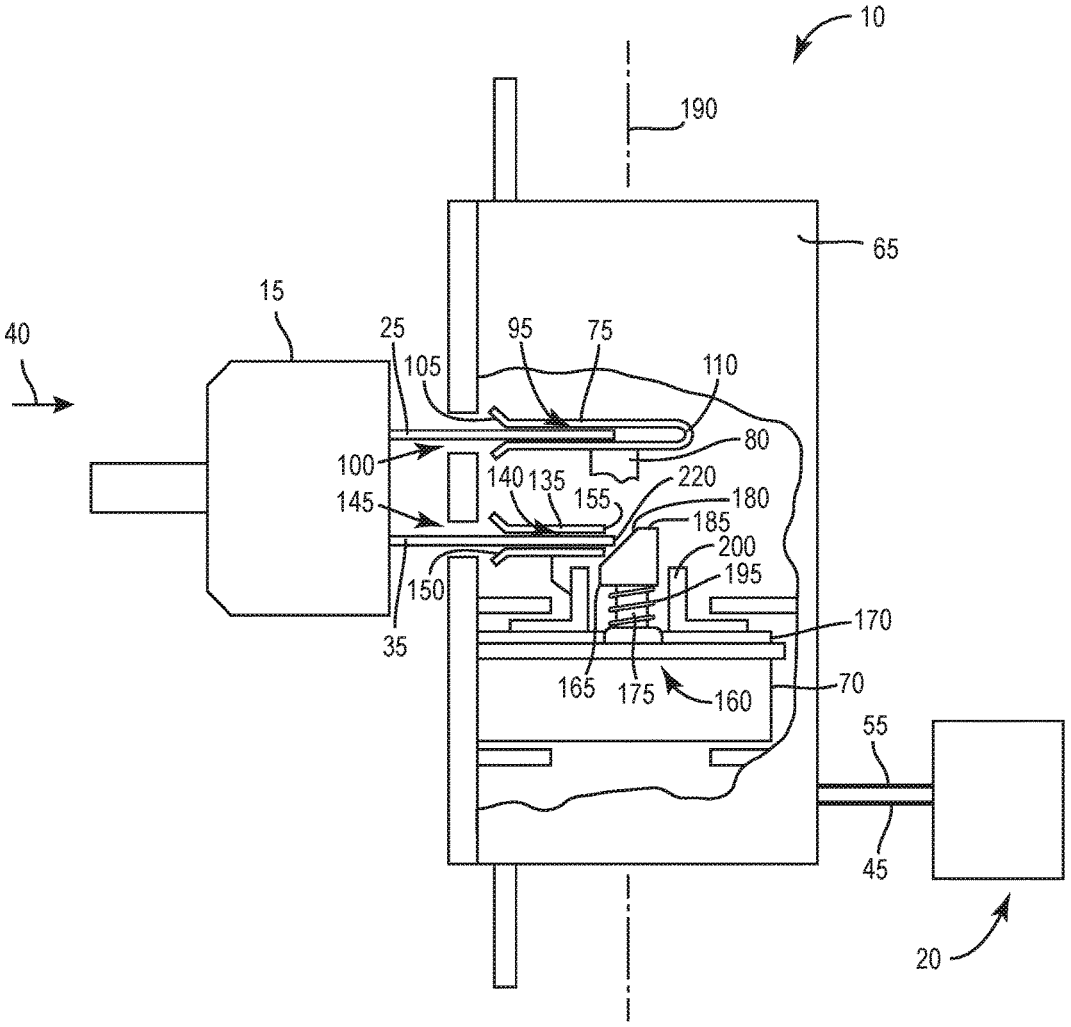
FIG. 5 is a partial cross sectional view of the electrical receptacle of FIG. 1 illustrating the electrical plug inserted within the electrical receptacle in a second position.
Figure 6:
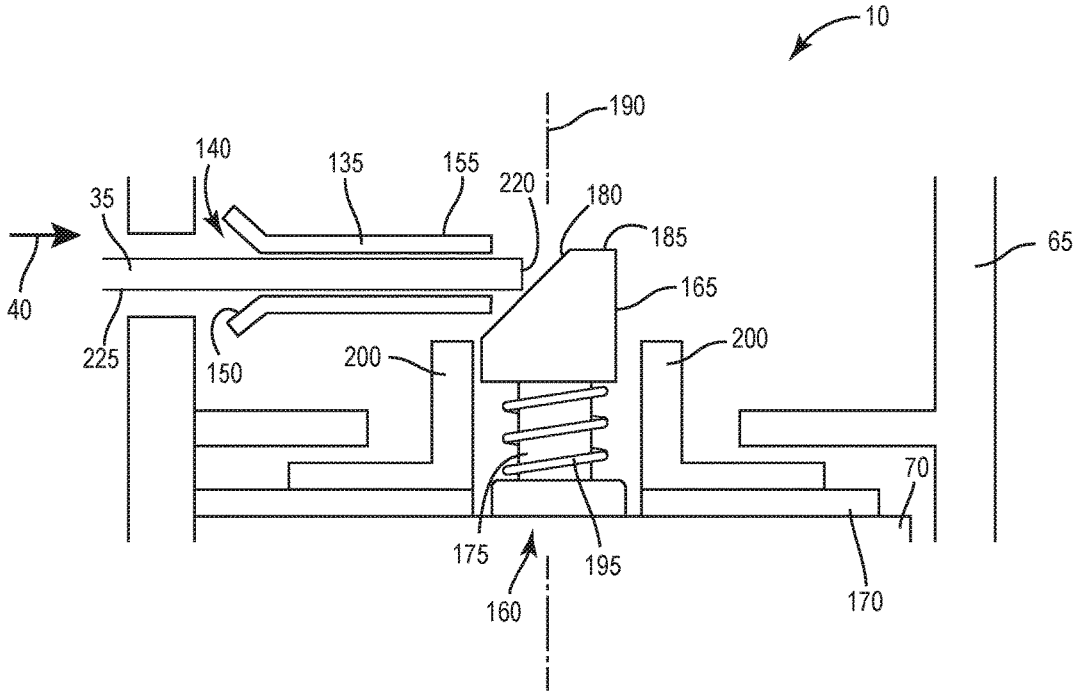
FIG. 6 is a detailed view of the second position of the electrical plug of FIG. 5 and a switch of the electrical receptacle.

An intermediate or second stage of insertion as illustrated in FIGS. 5 and 6 includes the prongs 25, 30, 35 being inserted within and in direct contact with the respective channels 95, 115, 140. In the second stage, an end 220 of the grounding prong 35 abuts the ramped surface 180 of the body 165. The contacts 75, 85 remain de-energized (the switch 160 is in the first position) even though the prongs 25, 30 are in direct contact with the respective contacts 75, 85.

Figure 9:
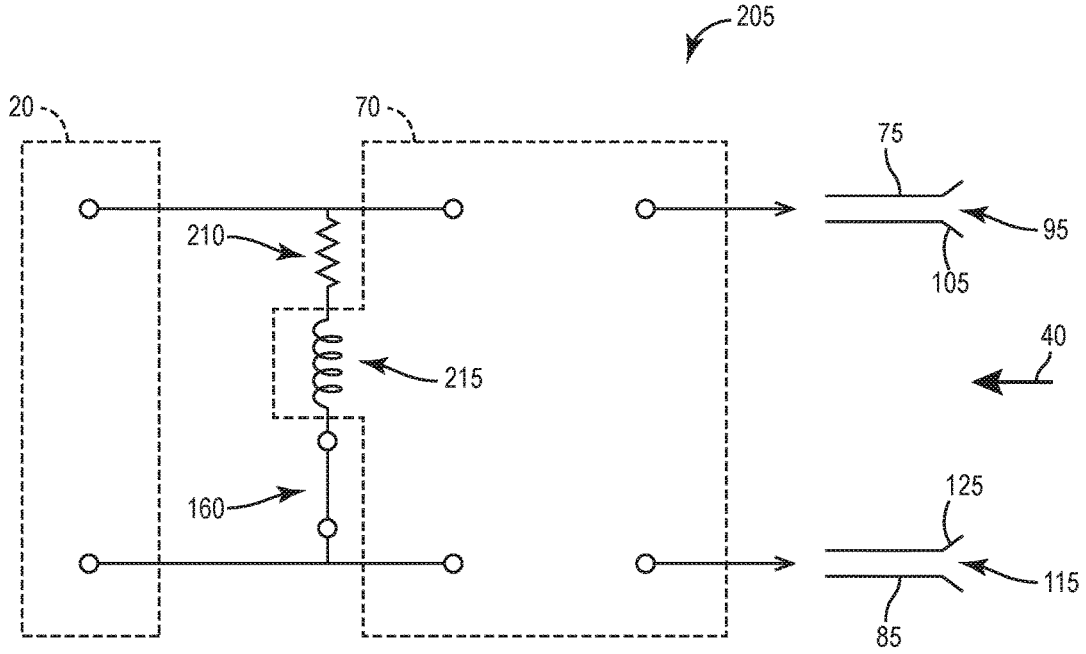
FIG. 9 illustrates the electrical circuit diagram of the electrical receptacle of FIG. 1 with the switch in a second position.

A final or third stage of insertion as illustrated in FIGS. 7 and 8 includes the majority of the electrical plug 15 inserted within the electrical receptacle 10 (e.g., the end 220 of the grounding prong 35 extends beyond the second end 155 of the grounding contact 135). In particular, the end 220 of the grounding prong 35 slidably engages the ramped surface 180 as the grounding prong 35 moves relative to the body 165 (e.g., the grounding prong 35 moves relative to the body 165 in a direction parallel to the insertion direction 40, and the body 165 moves relative to the grounding prong 35 in a direction perpendicular to the insertion direction 40). As such, the grounding prong 35 moves the switch 160 into the second position. In addition, the top surface 185 of the body 165 is biased into engagement with a bottom surface 225 of the grounding prong 35. With reference to FIG. 9, once the grounding prong 35 moves the switch 160 into the second position, the switch 160 moves into a closed electrical state such that the power relay 70 allows the flow of electrical current from the power source 20 to the contacts 75, 85 (e.g., the contacts 75, 85 are energized). In other embodiments, the switch 160 may be an electronic sensor that monitors the position of the grounding prong 35 (e.g., does not require direct engagement between the body 165 and the grounding prong 35). Accordingly, the power source 20 is enabled to power the electrical devices 16. In contrast, when removing the electrical plug 15 (moving in a direction opposite the insertion direction 40), the power source 20 is disabled from powering the electrical devices 16 when the electrical plug 15 moves back into the second stage (FIGS. 5 and 6) from the third stage (FIGS. 7 and 8).

The circuit 205 automatically energizes or de-energizes the contacts 75, 85 once the electrical plug 15 is in a certain position within the electrical receptacle 10 without any input from an operator inserting the electrical plug 15. The circuit 205 does not provide electrical current from the power source 20 to the electrical plug 15 until the majority of the electrical plug 15 is inserted into the electrical receptacle 10. In addition, the electrical receptacle 10 will remain de-energized if, for example, the grounding prong 35 is broken off of the electrical plug 15 (e.g., the grounding prong 35 would not engage the body 165). By de-energizing the contacts 75, 85 when the electrical plug 15 is initially inserted into the electrical receptacle 10 (during the first and second stages of insertion; FIGS. 4, 5, and 6), electrical sparking between the contacts 75, 85 and the prongs 25, 30 is avoided. Electrical sparking is characterized when electrical current jumps from one surface (e.g., the contacts 75, 85) to another surface (e.g., the prongs 25, 30), thereby creating a spark of electricity. Electrical sparking can damage the prongs 25, 30 and/or the contacts 75, 85 and is not desirable.

In addition, because the switch 160 moves along the axis 190 that is perpendicular to the insertion direction 40, other embodiments of the electrical plug 15 are still compatible with the electrical receptacle 10. For example, another embodiment of the electrical plug 15 may include a grounding prong that is longer than the grounding prong 35 illustrated in the drawings. The longer grounding prong is still operable to engage and move the body 165. The longer grounding prong engages the ramped surface 180 and simply extends a greater distance beyond the body 165 than the illustrated grounding prong 35 when the electrical plug 15 is fully inserted within the electrical receptacle 10. This is advantageous to have one electrical receptacle 10 that is capable of receiving different sizes/configurations of the electrical plug 15.

Furthermore, the switch 160 provides a safety feature of the electrical receptacle 10 if the grounding prong 35 is absent (e.g., if the grounding prong or a portion thereof is broken off from the electrical plug 15). The absence of the grounding prong 35 will result in no engagement with the switch 160, and as a result the electrical receptacle 10 will remain de-energized. This will protect the operator from the electrical plug 15 being energized by the electrical receptacle 10 in an ungrounded condition.

In other embodiments, the switch 160 may be associated with one or both of the first and second contacts 75, 85. For example, the body 165 may be positioned within one or both of the first and second channels 95, 115 in the first position until one of the first and second prongs 25, 30 slidable engages the body 165 to move the body 165 into the second position. In this embodiment, the body 165 is moveably biased along an axis that is generally perpendicular to the insertion direction 40 and the axis 190. In further embodiments, the contacts 75, 85 may include an open second end 110, 130 (similar to the open second end 155 of the grounding contact 135) with the switch 160 positioned adjacent one of the open second ends 110, 130. In other embodiments, the electrical plug 15 may include more or less than three prongs, may omit the grounding prong 35, and/or may orient the prongs 25, 30, 35 differently relative to each other.

Although aspects have been described in detail with reference to certain preferred embodiments, variations and modifications exist within the scope and spirit of one or more independent aspects as described.

The invention claimed is:

1. An electrical receptacle electrically coupled to a power source, the electrical receptacle selectively coupled to a power plug, the power plug including a plurality of prongs insertable into the electrical receptacle, the electrical receptacle comprising:

a first contact configured to be engageable with a first prong of the plurality of prongs;

a second contact configured to be engageable with a second prong of the plurality of prongs;

a power relay in electrical communication with the power source and the first contact; and a switch electrically coupled to the power relay and positioned adjacent an end of the second contact, the switch moveable between a first position and a second position, the switch biased toward the first position without being locked in the first position;

wherein the power relay is configured to disable electrical communication between the power source and the first contact when the switch is positioned in the first position; and wherein the power relay is configured to enable electrical communication between the power source and the first contact in response to the second prong slidably engaging the switch to move the switch into the second position.

2. The electrical receptacle of claim 1, wherein the first contact is a power contact configured to provide electrical current from the power source to the first prong, and wherein the second contact is a grounding contact.

3. The electrical receptacle of claim 1, wherein the switch is moveably biased in a direction substantially perpendicular to an insertion direction of the first and second prongs within the electrical receptacle.

4. The electrical receptacle of claim 3, wherein the switch includes a ramped surface, and wherein the ramped surface is configured to engage an end of the second prong such that the second prong moves the switch into the second position when the power plug is inserted within the electrical receptacle.

5. The electrical receptacle of claim 4, wherein the switch includes a top surface, and wherein the top surface of the switch is biased into engagement with the second prong when the power plug is inserted within the electrical receptacle.

6. The electrical receptacle of claim 1, further comprising a third contact configured to be engageable with a third prong of the plurality of prongs.

7. An electrical receptacle electrically coupled to a power source, the electrical receptacle selectively coupled to a power plug, the power plug including a plurality of prongs insertable into the electrical receptacle, the electrical receptacle comprising:

a contact configured to be engageable with one of the plurality of prongs;

a power relay in electrical communication with the power source and the contact; and a switch electrically coupled to the power relay, the switch axially moveable between a first position and a second position, the switch biased toward the first position;

wherein the power relay is configured to disable electrical communication between the power source and the contact when the switch is positioned in the first position; and wherein the power relay is configured to enable electrical communication between the power source and the contact in response to the one of the plurality of prongs slidably engaging the switch to move the switch into the second position.

8. The electrical receptacle of claim 7, wherein the switch is moveably biased in a direction substantially perpendicular to an insertion direction of the one of the plurality of prongs within the electrical receptacle.

9. The electrical receptacle of claim 8, wherein the switch includes a ramped surface, and wherein the ramped surface is configured to engage an end of the one of the plurality of prongs such that the one of the plurality of prongs is configured to move the switch into the second position when the power plug is inserted within the electrical receptacle.

10. The electrical receptacle of claim 9, wherein the switch includes a top surface, and wherein the top surface of the switch is biased into engagement with the one of the plurality of prongs when power plug is inserted within the electrical receptacle.

11. The electrical receptacle of claim 7, further comprising a second contact configured to be engageable with a second one of the plurality of prongs and a third contact configured to be engageable with a third one of the plurality of prongs of the power plug.

12. The electrical receptacle of claim 7, wherein the contact is a grounding contact, and wherein the one of the plurality of prongs is a grounding prong.

13. An electrical receptacle electrically coupled to a power source, the electrical receptacle selectively coupled to a power plug, the power plug including a plurality of prongs insertable into the electrical receptacle, the electrical receptacle comprising:

a contact configured to be engageable with one of the plurality of prongs;

a power relay in electrical communication with the power source and the contact; and a switch electrically coupled to the power relay, the switch moveably biased in a direction substantially perpendicular to an insertion direction of the one of the plurality of prongs within the electrical receptacle;

wherein the power relay is configured to block electrical communication between the power source and the contact when the switch is positioned in the first position; and wherein the power relay is configured to enable electrical communication between the power source and the contact in response to the one of the plurality of prongs moving the switch into the second position.

14. The electrical receptacle of claim 13, wherein the one of the plurality of prongs slidably engages the switch to move the switch into the second position.

15. The electrical receptacle of claim 13, wherein the switch includes a ramped surface, and wherein the ramped surface is configured to engage an end of the one of the plurality of prongs such that the one of the plurality of prongs is configured to move the switch into the second position when the power plug is inserted within the electrical receptacle.

16. The electrical receptacle of claim 15, wherein the switch includes a top surface, and wherein the top surface of the switch is biased into engagement with the one of the one of the plurality of prongs when power plug is inserted within the electrical receptacle.

17. The electrical receptacle of claim 13, further comprising a second contact configured to be engageable with a second one of the plurality of prongs, and a third contact configured to be engageable with a third one of the plurality of prongs.

18. The electrical receptacle of claim 13, wherein the contact is a grounding contact, and wherein the one of the plurality of prongs is a grounding prong.

* * * * *